US011669050B2

(12) United States Patent
Favre et al.

(10) Patent No.: US 11,669,050 B2
(45) Date of Patent: Jun. 6, 2023

(54) WATCH SELF-WINDING DEVICE WITH ROTARY MOTION

(71) Applicant: The Swatch Group Research and Development Ltd, Marin (CH)

(72) Inventors: Jérôme Favre, Neuchâtel (CH); Cedric Nicolas, Neuchâtel (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 330 days.

(21) Appl. No.: 17/024,928

(22) Filed: Sep. 18, 2020

(65) Prior Publication Data

US 2021/0181687 A1 Jun. 17, 2021

(30) Foreign Application Priority Data

Dec. 12, 2019 (EP) ..... 19215629

(51) Int. Cl.
*G04C 1/08* (2006.01)
*G04B 3/00* (2006.01)

(52) U.S. Cl.
CPC ..... *G04C 1/082* (2013.01); *G04B 3/006* (2013.01)

(58) Field of Classification Search
CPC ..... G04C 1/082; G04D 7/009; G04D 1/063; G04D 7/1264; G04B 3/006; G04B 5/00; G04B 5/02
See application file for complete search history.

(56) References Cited

U.S. PATENT DOCUMENTS 6,543,929 B1 4/2003 Agnoff
6,910,802 B2 * 6/2005 Rustioni ..... G04D 7/009 81/7.5

(Continued)

FOREIGN PATENT DOCUMENTS

AU 6160999 A 4/2000
CN 103399480 A 11/2013

(Continued)

OTHER PUBLICATIONS

European Search Report dated May 26, 2020 in European Application 19215629.7 filed Dec. 12, 2019 (with English Translation of Categories of Cited Documents), 3 pages.

(Continued)

*Primary Examiner* — Edwin A. Leon
(74) *Attorney, Agent, or Firm* — Oblon, McClelland, Maier & Neustadt, L.L.P.

(57) ABSTRACT

A watch self-winding device with rotary motion, including a base carrying a motor driving in rotation a support carrying a watch and includes an upper watch holder with a surface in direct contact with a watch, this support includes a microphone for listening to a watch and an embedded electronic circuit processing the signal from the microphone, the device includes, in order to supply power to the embedded electronic circuit, a first coil fixed to the base and powered by a power source carried or relayed by the base, and a second coil embedded in the support, coaxial to the first coil and arranged to transmit power to the embedded electronic circuit, which is arranged to exchange information with a static electronic circuit in the base.

14 Claims, 4 Drawing Sheets

(56) References Cited

U.S. PATENT DOCUMENTS

| | | | | |
|---|---|---|---|---|
| 7,198,401 | B2 * | 4/2007 | Louie | G04B 3/006 81/7.5 |
| 7,575,367 | B2 * | 8/2009 | Wolf, V | G04D 7/009 81/7.5 |
| 9,223,294 | B2 * | 12/2015 | Ng | G04B 3/006 |
| 9,292,000 | B2 * | 3/2016 | Lamarche | G04B 7/00 |
| 2012/0082011 | A1 | 4/2012 | Liao | |

FOREIGN PATENT DOCUMENTS

| | | | |
|---|---|---|---|
| CN | 203982083 | U | 12/2014 |
| CN | 108227451 | A | 6/2018 |
| CN | 109962513 | A | 7/2019 |
| EP | 1 288 744 | A1 | 3/2003 |
| EP | 1 288 744 | B1 | 3/2003 |
| EP | 3 096 191 | A1 | 11/2016 |
| EP | 3 096 191 | B1 | 11/2016 |
| JP | 2015-61263 | A | 3/2015 |
| TW | M399634 | U1 | 3/2011 |

OTHER PUBLICATIONS

Combined Chinese Office Action and Search Report dated Nov. 11, 2021 in corresponding Chinese Patent Application No. 202011022087.4 (with English Translation of Category of Cited Documents), 7 pages.

* cited by examiner

WATCH SELF-WINDING DEVICE WITH ROTARY MOTION

CROSS-REFERENCE TO RELATED APPLICATION

This application claims priority to European Patent Application No. 19215629.7 filed on Dec. 12, 2019, the entire disclosure of which is hereby incorporated herein by reference.

FIELD OF THE INVENTION

The invention relates to a watch self-winding device with rotary motion, comprising a base carrying a motor for driving a mobile support in rotation relative to said base, which support is arranged so as to receive a mechanical watch or an electronic watch with a mechanical power source in a winding position, and comprises at least one upper watch holder comprising a receiving surface for direct contact with a watch fixed to said support.

The invention relates to the field of storing and maintaining watches, and in particular to the winding thereof, and to the adjustment of the rate thereof and/or to the adjustment of the state thereof. The invention more particularly relates to the field of self-winding mechanisms, and the optimisation thereof in order to provide the user with a watch having a sufficient power reserve, with a well-adjusted rate and a correct display state.

BACKGROUND OF THE INVENTION

The European patent document EP33339984B1 filed by The Swatch Group Research & Development Ltd describes a device for winding watches, comprising acoustic watch inspection means for determining the level of winding or optimal recharging.

Such a current winding device has a microphone for characterising the operation of the watch (rate and amplitude). This microphone must be powered and connected to a fixed base by a cable. This cable has several drawbacks:

it becomes tangled during winding operations;

it hinders handling by the user;

it is visible and detrimental to aesthetics.

Of course, winding can take place by moving the watch holder back and forth (for example an oscillating rotary motion of ±60°) to prevent the cable from becoming tangled, however efficiency is mediocre in the case of a watch wound using an oscillating weight due to the angle required by the oscillating weight to engage. The alternative comprising using a flexible ribbon of conductors, cleverly concealed to minimise hindrance when handling and the aesthetic impact thereof, is not sufficiently reliable as a result of friction and the risk of becoming blocked.

SUMMARY OF THE INVENTION

The present invention proposes developing this principle of acoustically evaluating the degree of winding of a watch.

It further involves doing away with the need for the cable linkage between the microphone and the base, which is very limiting. The elimination of the cable connecting the contact microphone of the winding device to the fixed base allows for continuous winding and improves the ergonomics and aesthetics.

The invention thus relates to a watch self-winding device with rotary motion according to claim 1.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 1:
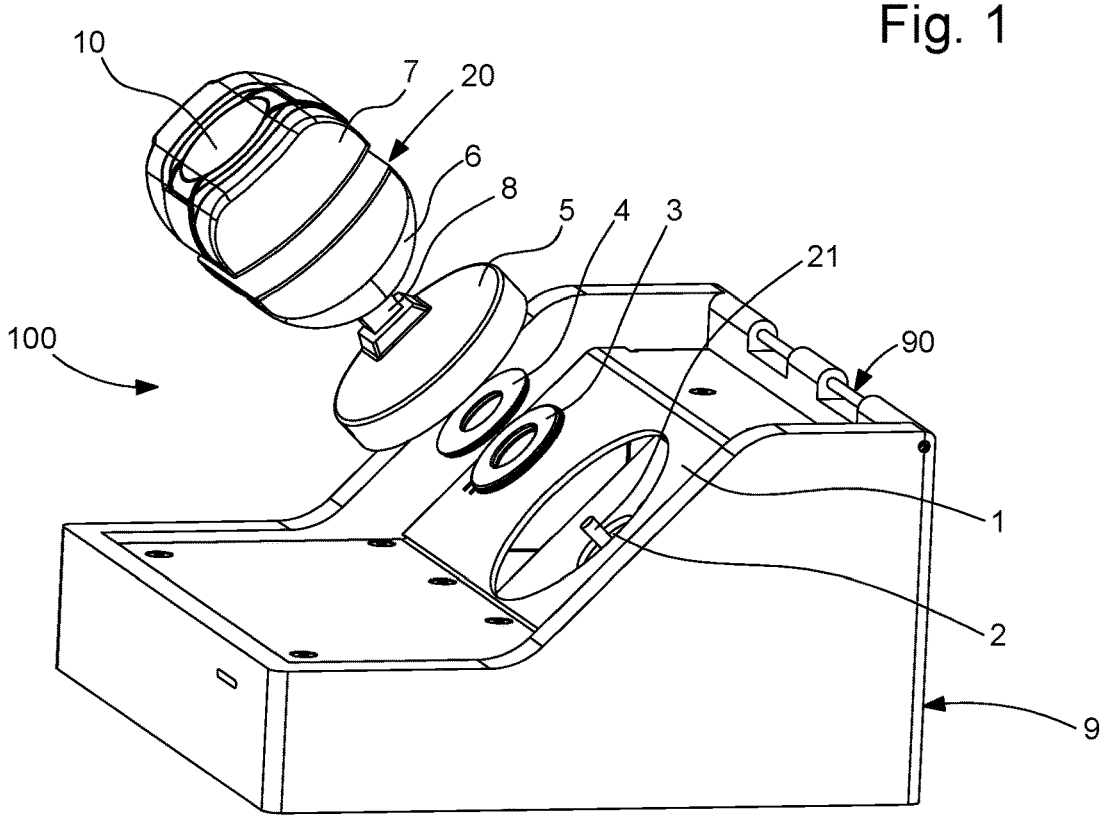
FIG. 1 diagrammatically shows an exploded, perspective view of a device according to the invention, with the lower part of a case formed by a base carrying a motor, the output shaft whereof can be seen inside an opening of the base; a fixed coil is disposed in the vicinity of this motor and powered, so as to transmit, in a contactless manner, power to a second coil, which is capable of moving and belongs to an assembly which comprises, in the upper part thereof, a support receiving a watch, this support containing a microphone not visible in this figure.

The European patent document EP33339984B1 filed by The Swatch Group Research & Development Ltd, incorporated herein as a reference, describes a watch winding device for mechanical watches or electronic watches with a mechanical power source. This device comprises at least one power source arranged to power at least one motor.

This motor is arranged either to turn the winding button of a manually wound watch, or to drive at least one oscillating weight of a self-winding watch, or to rock at least one self-winding watch. The device comprises control means which comprise first acoustic measuring means incorporating sensor means for the acoustic measurement of the oscillator of at least one watch placed in the winding position. These first acoustic measuring means in particular comprise a microphone.

The control means are arranged to analyse signals transmitted by these first acoustic measuring means and compare them to setpoint values which can be configured to regulate the rate of the motor by starting this motor when the operating amplitude of the oscillator is less than or equal to a first minimum value, and by stopping this motor when the operating amplitude of the oscillator is greater than or equal to a second maximum value.

These first acoustic measuring means are arranged in a fixed position in a base behind an input orifice. Moreover, the device comprises at least one acoustic duct, which places a receiving orifice located inside a chamber for housing a watch, in communication with a transmitting orifice. The control means control drive means which determine the motion and the position in space of this transmitting orifice, in order, during a programmed or user-initiated operation to measure the rate of a watch fixed inside the recess, to position and immobilise this transmitting orifice in an indexing position facing the input orifice, and in the immediate vicinity thereof or in contact therewith.

This device advantageously comprises optical means which cooperate with the control means to reach said indexing position.

More particularly, this device comprises second acoustic measuring means for measuring ambient noise in the vicinity of the device during the measurement. Moreover, the control means are arranged to correct, by subtracting this ambient noise, the acoustic measurement made by the first acoustic measuring means during the measuring operation.

This device advantageously comprises at least one support capable of moving relative to the base, which support is arranged to receive a mechanical watch or an electronic watch with a mechanical power source in a winding position. Each such support comprises such an acoustic duct. The transmitting orifice is located at the periphery of the support. Moreover, the control means control the same drive means which determine the motion and the position in space of the support, in order, during a programmed or user-initiated operation to measure the rate of a watch fixed inside the recess, to position and immobilise the transmitting orifice in an indexing position facing the input orifice, and in the immediate vicinity thereof or in contact therewith.

This patent document further describes the use of such a device for winding an electronic watch comprising a generator with a mechanical power source. The control means thus comprise measuring means which incorporate sensor means for measuring the field produced by this generator in order to control regulation of the power recharge.

This patent document further describes the steps of a method for preparing a watch using this device:

the watch is placed on this device;

the angular position in which the watch rate is most accurate is determined;

the degree of winding, when the watch has a mechanical power source, or the degree of charging, when the watch has an electrical power source, at which the rate of said watch is the most stable, is determined;

the watch is held both in this angular position, and in the degree of winding, or respectively the degree of charging, corresponding to the optimum rate of this watch.

The present invention proposes developing this principle of acoustically evaluating the degree of winding of a watch.

It further involves doing away with the need for the cable linkage between the microphone and the base, which is very limiting. The elimination of the cable connecting the contact microphone of the winding device to the fixed base allows for continuous winding and improves the ergonomics and aesthetics.

The invention comprises powering the electronic circuit using at least two coils arranged so as to cooperate with one another for a power transfer, and which are more particularly coaxial, but not limited thereto.

Use of the protocol according to the FHSS ("frequency hopping spread spectrum") technique, in particular of the "Bluetooth" type or of a similar type, is suitable for the wireless communication between the microphone unit and the fixed base.

With the exception of this power supply and of this wireless communication, the principle is that of the principles disclosed in the European patent document EP33339984B1 incorporated herein as a reference, as well as in the European patent applications EP3410235, EP3410326, EP18173402 and EP18208249 filed by The Swatch Group Research & Development Ltd, incorporated herein as a reference: measuring the amplitude, rate servo-control algorithm, trembling action to correct the rate and/or the state of the watch, or winding action.

The watch is preferably held, as shown, by a microphone unit integral with the base, or with a case acting as a base, which is ergonomic for the user. More particularly, this microphone unit is made of a plurality of parts. According to the non-limiting alternative embodiment shown in the figures, it comprises an upper watch holder half, which encloses the microphone, and a lower watch holder half, mounted such that it pivots relative to the base.

More particularly, this microphone is a contact microphone, in particular of the piezoelectric microphone type, so as to obtain the best possible signal to noise ratio. This piezoelectric microphone is advantageously housed directly beneath the watch, in particular in the upper watch holder half in the alternative embodiment shown in the figures.

One advantageous alternative embodiment comprises placing this piezoelectric microphone in contact with the winding button of the watch, since the winding and setting stem of the watch directly penetrate the core of the movement, where the measurement of the noise of the escapement is even better, which prevents damping due to the back and the back joints which is unavoidable when the piezoelectric microphone is placed directly beneath the back of the watch case. However, it is more difficult to produce such a piezoelectric microphone for contact on the winding button for a wide variety of different watches; it is thus more advantageous for the preparation of watches of the same type, or of very similar types, as regards the positioning of the winding buttons thereof.

Another alternative embodiment comprises equipping the winding device with an aerial microphone and an acoustic duct leading to the watch, for example with an aerial microphone in the lower watch holder half; however, sensitivity to ambient noise makes this simple and inexpensive solution less accurate than that of the piezoelectric microphone in direct contact with the watch.

Thus, and as shown in the figures, the invention more particularly relates to a watch self-winding device 100 with rotary motion. This device 100 comprises a base 1 carrying a motor 2 for driving the rotation of a support 20 capable of moving relative to the base 1.

This support 20 is arranged so as to receive a mechanical watch or an electronic watch with a mechanical power source in a winding position, and comprises at least one upper watch holder 7 comprising a receiving surface for direct contact with a watch 10 fixed to the support 20.

According to the invention, the support 20 comprises at least one microphone 30 for listening to a watch 10, and at least one embedded electronic circuit 40 housed inside the support 20 for processing the signal from each microphone 30. Moreover, the device 100 comprises, in order to supply power to each embedded electronic circuit 40, both at least one first coil 3, fixed to the base 1 or to the motor 2, and which is powered by a static power source 63 carried or relayed by the base 1, and at least one second moving coil 4, embedded in the support 20, which is arranged to cooperate with at least one first coil 3, and more particularly with each first coil 3, and which is arranged to transmit power to each embedded electronic circuit 40. A relatively low power in the order of 1 W is sufficient for powering the embedded electronic circuit 40 alone. The first coil 3 is, for example, powered at 5 V, with a current in the order of 0.1 A.

More particularly, at least one second coil 4 is coaxial to a first coil 3. Even more particularly, all of the first coils 3 are coaxial to one another. Even more particularly, all of the second coils 4 are coaxial to one another. Even more particularly, all of the first coils 3 and all of the second coils 4 are coaxial to one another.

It is understood that the notion of coaxiality is useful for an acoustic measurement, and/or for a power transfer. The first 3 and the second 4 coils can thus conceivably be made coaxial during these phases only.

Figure 2:
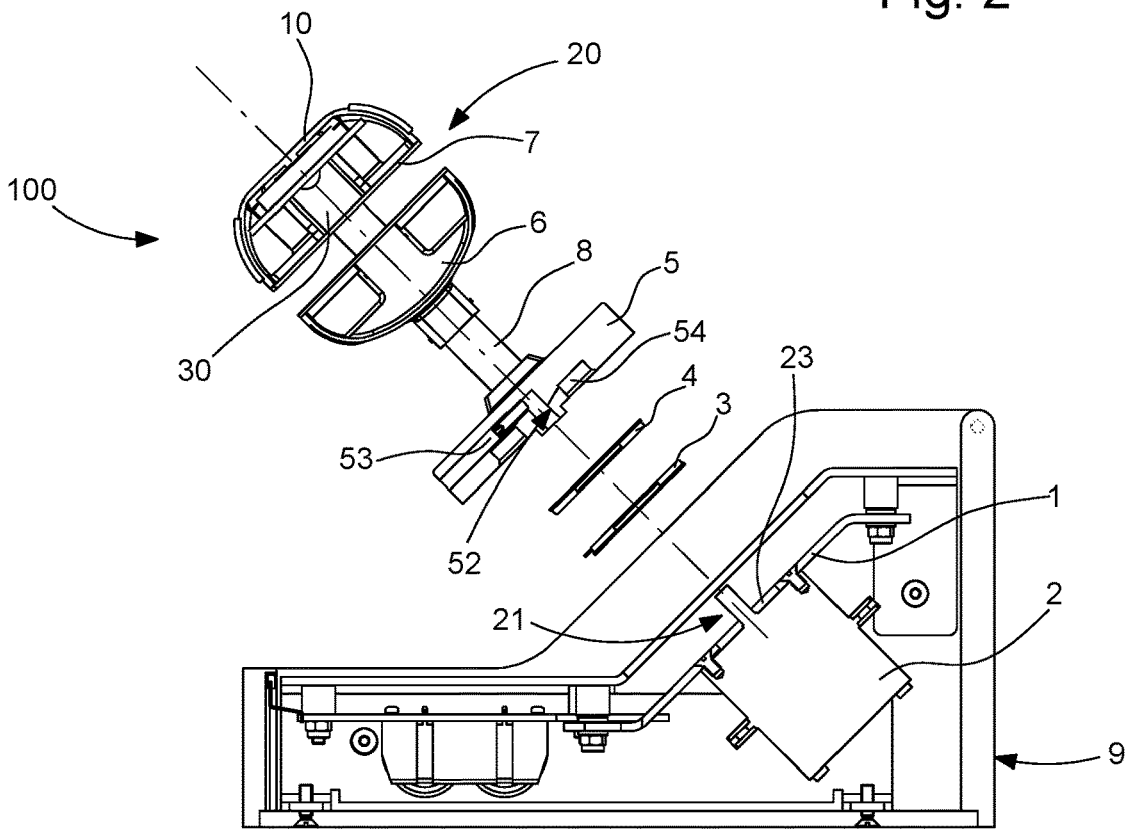
FIG. 2 diagrammatically shows an exploded sectional view, passing through the axis of the motor, of the device in FIG. 1, the microphone whereof can be seen inside a recess of an upper watch holder placed at the distal end of the support, immediately below the movement of the watch.
Figure 3:
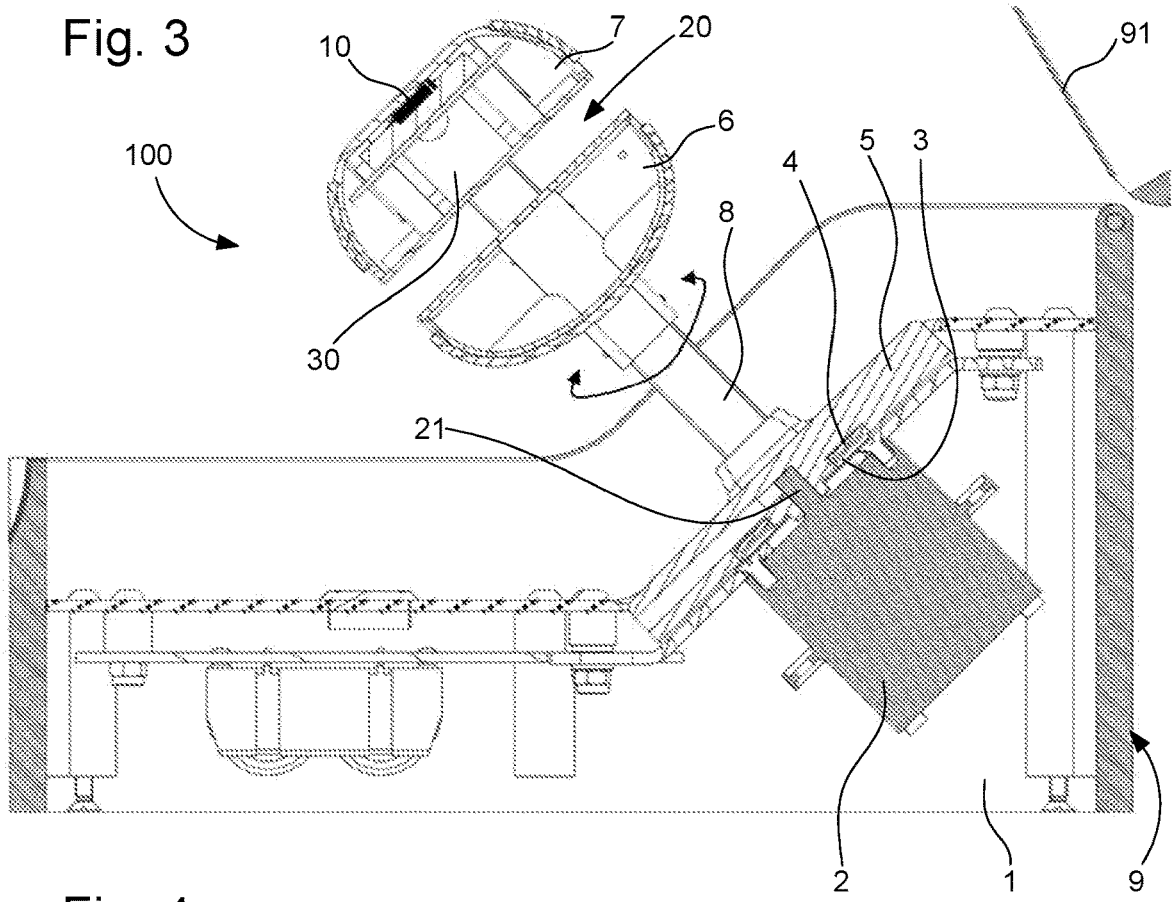
FIG. 3 diagrammatically shows an assembled sectional view, passing through the axis of the motor, of the same device.

FIGS. 1 to 3 show a non-limiting arrangement of these coils: the first coil 3 at the front face of the motor 2, in particular in a spot face 23, and the second coil 4 in a recess 54, for example a groove, comprised in a flange 5 of the support 20. This flange 5 comprises a bore 52 cooperating with a shaft 21 of the motor 2, which shaft 21 is clamped by a screw 53 mounted radially in the flange 5. In this case, this flange 5 carries a column 8 which allows the space beneath the support 20 to be freed, and in particular the space beneath a lower watch holder 6, in order to facilitate the assembly of the bracelet of a watch 10 on the support 20.

At least one embedded electronic circuit 40 is arranged to exchange information with at least one static electronic circuit 60 housed at the base 1. Thus, the power transfer is carried out in a contactless manner between the coils. More particularly, each second coil 4 is coaxial to each first coil 3 and to an output shaft 21 of the motor 2. In an alternative embodiment, the support 20 is moved in a rotary motion about the output shaft 21 of the motor 2. In another alternative embodiment, the support 20 is moved in a rotary motion that is eccentric relative to the output shaft 21 of the motor 2.

More particularly, at least one embedded electronic circuit 40 is arranged to exchange information, in a contactless manner, with at least one static electronic circuit 60 housed at the base 1.

More particularly, this embedded electronic circuit 40 and this static electronic circuit 60 comprise or control exchange peripherals, which are respectively dynamic 49 and static 69, and which are arranged so as to exchange information, in a contactless manner, by short-distance digital data communication via radiofrequency waves, in particular according to a frequency hopping spread spectrum such as "Bluetooth" or similar. In particular, the static exchange peripheral 69, in particular an antenna, at the base 1, can be a neighbouring component of the static electronic circuit 60, or a track of a printed circuit comprised in this static electronic circuit 60, or similar. The embedded exchange peripheral 49 is more particularly housed at the upper watch holder 7.

In another alternative embodiment, the first coil 3 and the second coil 4 are also used for the information transfer, in addition to the power transfer; of course, this alternative embodiment is a little more complex to implement than the alternative embodiment with separate transfers, on the one hand for the power, on the other hand for the signals, but it remains perfectly feasible.

More particularly, in an alternative embodiment not shown, the support 20 comprises at least one second drive means, powered by the second coil 4, controlled by the embedded electronic circuit 40, and arranged to subject at least the upper watch holder 7 to a motion non-coaxial to the rotational axis of the support 20. In an alternative embodiment, this non-coaxial motion is a rotary motion. In another alternative embodiment, this non-coaxial motion is a translational motion. In yet another alternative embodiment, this non-coaxial motion is a complex motion according to a plurality of degrees of freedom. More particularly, this non-coaxial motion is a random motion controlled by a random generator circuit comprised in the embedded electronic circuit 40.

In a non-limiting specific application, the purpose of this non-coaxial motion is to orient a watch towards a viewing means 61 such as a camera, and/or towards lighting means, which can thus be disposed outside of the user's field of view.

In yet another alternative embodiment, the device 100 comprises at least one first coil 3 and at least one second coil 4 which are arranged specifically for a power transfer specific to the powering of actuators disposed in the support 20, such as motors or similar components, for example for a transfer of a few tens of Watts.

More particularly, at least one static electronic circuit 60 comprises or is interfaced with a temperature-compensated quartz oscillator 64.

More particularly, at least one static electronic circuit 60 is interfaced with viewing means 61, which are arranged to identify the state of the display of a watch 10 fixed to the support 20.

More particularly, the support 20 comprises at least one lower watch holder 6 arranged so as to carry a watch 10 in cooperation with the upper watch holder 7, and comprises motorised or elastic means for moving the lower watch holder 6 and the upper watch holder 7 away from one another.

More particularly, the base 1 constitutes the back of a case 9 comprising, for example, a hinge 90 and a cover 91.

In an alternative embodiment not shown, the device 100 can integrate, at the support 20, a self-centring device, which comprises an embedded adjustable weight to place the centre of inertia of the watch holder support 20, equipped with the watch 10, on the rotational axis. This function consumes little power, the coils 3 and 4 dimensioned so as to power the embedded electronic circuit 40 are sufficient for such a function, all the more so since this adjustment is only carried out once, immediately after assembling the watch 10 on the support 20, before the acoustic measurement and winding/trembling operations where appropriate.

Figure 4:
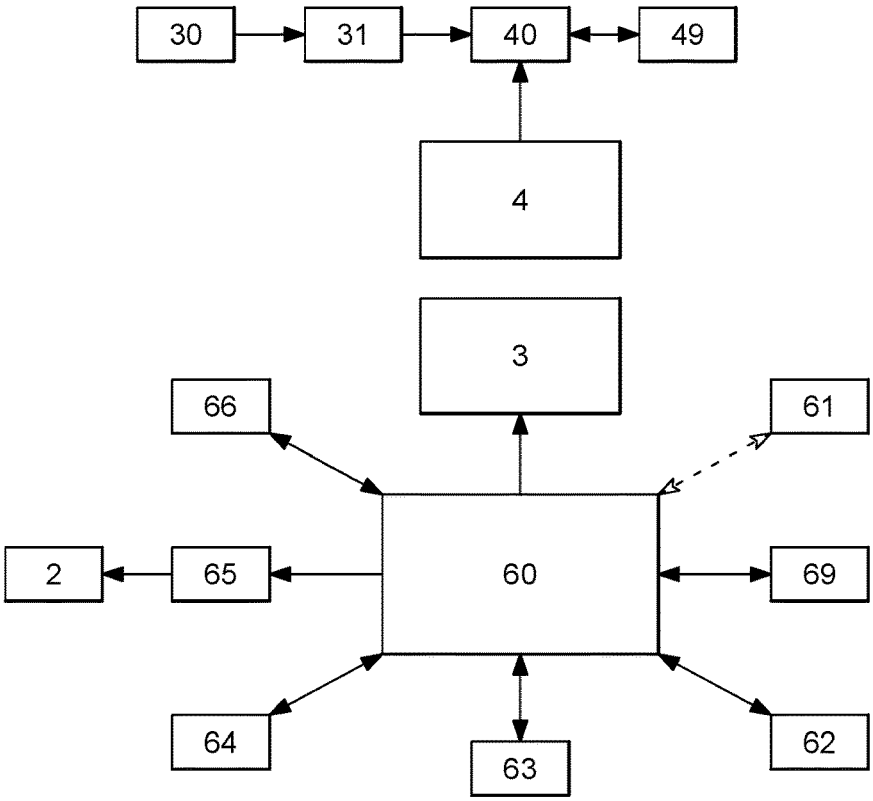
FIG. 4 is a block diagram showing the interaction of the power or signal generation, transmission, analysis and control modules.
Figure 5:
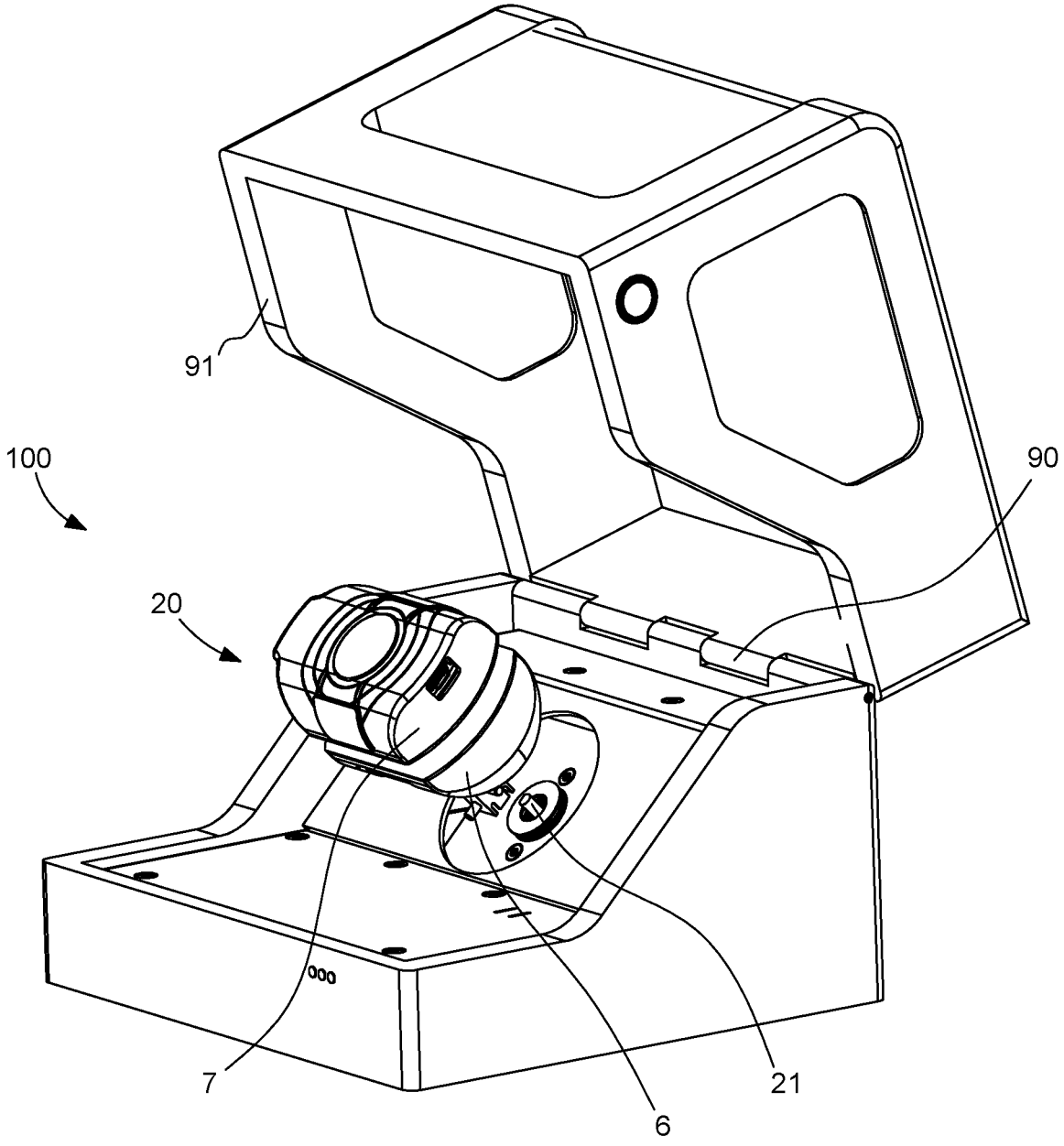
FIGS. 5 and 6 diagrammatically show a perspective view of a case comprising this device according to the invention, from different angles.
Figure 6:
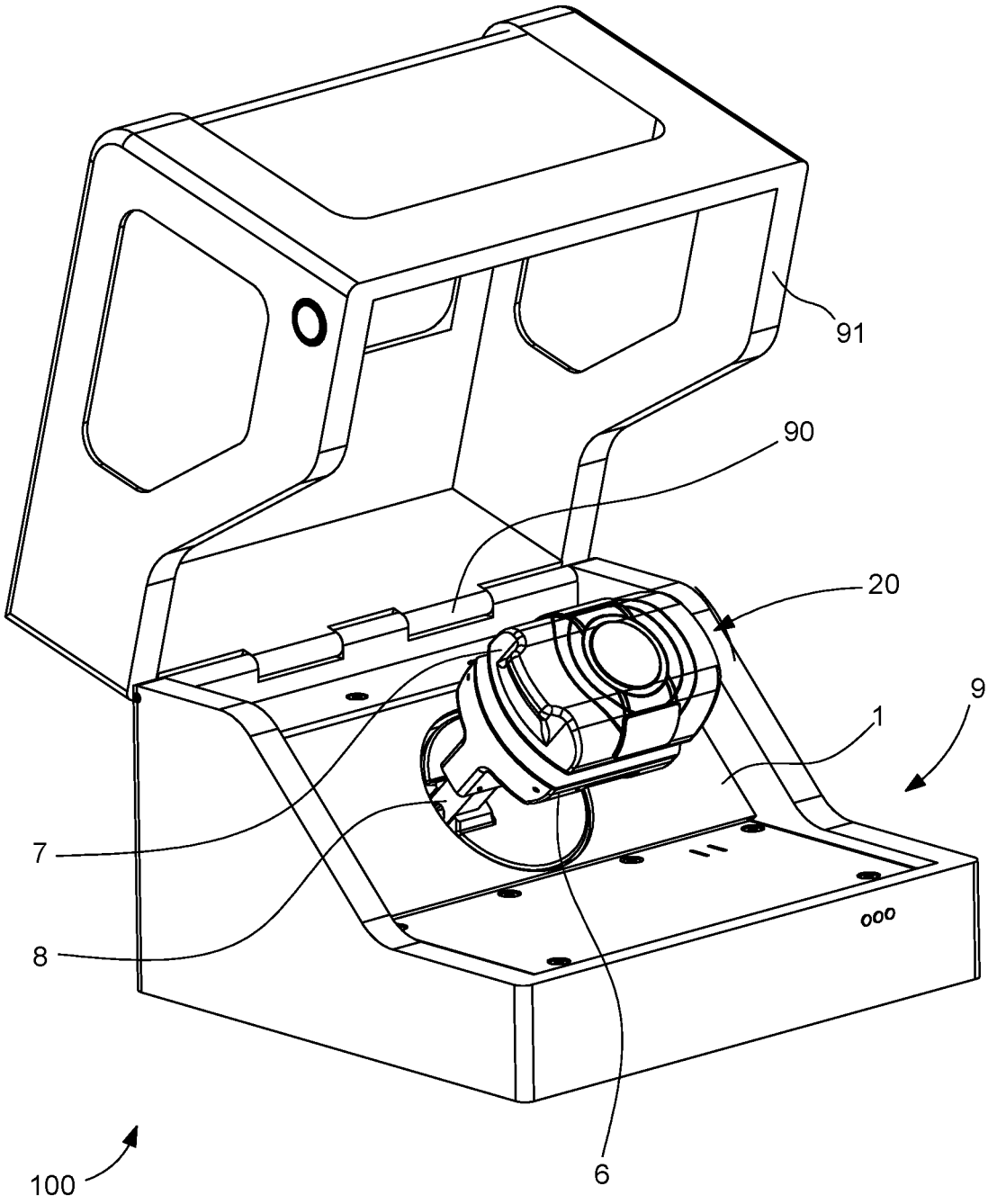

FIG. 4 shows a non-limiting example of the different function modules. In the lower part of the device 100, the static electronic circuit 60 constitutes the central control means, and manages those of the following peripherals which are installed on the device 100:

a viewing equipment item 61 for analysing the display state of the watch;

a static exchange peripheral 69, typically a "Bluetooth" antenna or similar component;

a user interface 62;

a battery 63;

a temperature-compensated quartz oscillator 64;

a motor 2 and the control module 65 thereof;

an exchange port 66, in particular of the universal serial bus "USB" type.

In the top part of the device, the embedded electronic circuit 40 in particular manages:

a dynamic exchange peripheral 49, typically a "Bluetooth" antenna or similar component;

a microphone 30, in particular of the piezoelectric type, and the signal amplifier 32 thereof.

The optimisation of certain factors allows the system to be enhanced:

increasing the power that the coils are capable of transmitting;

minimising the unbalance created by the holding structure in order to minimise consumption during winding;

minimising the inertia of the entire assembly in order to minimise consumption during trembling;

centring the watch (regardless of the size thereof) relative to the rotational axis of the watch holder to improve the aforementioned two points, as well as to facilitate recognition using the viewing module in the alternative embodiment comprising inspecting and adjusting the state of the watch.

The invention claimed is:

1. A watch self-winding device with rotary motion, comprising a base carrying a motor for driving a mobile support in rotation relative to said base, said support being arranged so as to receive a mechanical watch or an electronic watch with a mechanical power source in a winding position, and comprises at least one upper watch holder comprising a receiving surface for direct contact with said mechanical watch or said electronic watch fixed to said support, wherein said support comprises at least one microphone for listening to said mechanical watch or said electronic watch, and at least one embedded electronic circuit housed inside said support for processing a signal from each said microphone, and wherein said device comprises, in order to supply power to each said embedded electronic circuit, at least one first coil, fixed to said base or to said motor, and powered by a static power source carried or relayed by said base, and at least one second coil embedded in said support and arranged to cooperate with at least one said first coil, and arranged to transmit power to each said embedded electronic circuit, at least one said embedded electronic circuit whereof is arranged to exchange information with at least one static electronic circuit housed at said base.

2. The watch self-winding device according to claim 1, wherein at least one said second coil is coaxial with said first coil.

3. The watch self-winding device according to claim 1, wherein at least one said embedded electronic circuit is arranged to exchange information, in a contactless manner, with at least one static electronic circuit housed at said base.

4. The watch self-winding device according to claim 3, wherein said embedded electronic circuit and static electronic circuit comprise or control exchange peripherals, which are arranged so as to exchange information, in a contactless manner, by a frequency hopping spread spectrum protocol.

5. The watch self-winding device according to claim 1, wherein said support comprises at least one second drive means, powered by said second coil, controlled by said embedded electronic circuit, and arranged to subject at least said upper watch holder to a motion non-coaxial to the rotational axis of said support.

6. The watch self-winding device according to claim 5, wherein said non-coaxial motion is a rotary motion.

7. The watch self-winding device according to claim 5, wherein said non-coaxial motion is a translational motion.

8. The watch self-winding device according to claim 5, wherein said non-coaxial motion is a complex motion according to a plurality of degrees of freedom.

9. The watch self-winding device according to claim 5, wherein said non-coaxial motion is a random motion controlled by a random generator circuit comprised in said embedded electronic circuit.

10. The watch self-winding device according to claim 1, wherein at least one said static electronic circuit comprises or is interfaced with a temperature-compensated quartz oscillator.

11. The watch self-winding device according to claim 1, wherein at least one said static electronic circuit is interfaced with viewing means arranged to identify the state of the display of said mechanical watch or said electronic watch fixed to said support.

12. The watch self-winding device according to claim 1, wherein said support comprises at least one lower watch holder arranged so as to carry said mechanical watch or said electronic watch in cooperation with said upper watch holder, and comprises motorised or elastic means for moving said lower watch holder and said upper watch holder away from one another.

13. The watch self-winding device according to claim 1, wherein said base constitutes the back of a case.

14. The watch self-winding device according to claim 1, wherein the driving of said support in rotation is eccentric relative to the axis of said motor.

* * * * *